US005477989A

United States Patent [19]

Maas et al.

[11] Patent Number: 5,477,989

[45] Date of Patent: Dec. 26, 1995

[54] CHILD RESISTANT NOZZLE COVER

[75] Inventors: Wilhelmus J. J. Maas, Someren; Petrus L. W. Hurkmans, Someren, both of Netherlands

[73] Assignee: AFA Products, Inc., Forest City, N.C.

[21] Appl. No.: 330,698

[22] Filed: Oct. 28, 1994

[51] Int. Cl.[6] ..... B65D 50/00

[52] U.S. Cl. ..... 222/153.1; 215/216; 215/219; 222/182; 222/380; 222/153.14

[58] Field of Search ..... 222/153, 182, 222/380, 383, 153.14, 153.01, 153.03; 215/216, 219

[56] References Cited

U.S. PATENT DOCUMENTS

| | | | |
|---|---|---|---|
| 3,027,035 | 3/1962 | Farago | 215/219 |
| 3,878,961 | 4/1975 | Curry et al. | 215/219 |
| 3,885,712 | 5/1975 | Libit | 215/219 X |
| 3,892,325 | 7/1975 | Magurie | 215/219 |
| 3,934,744 | 1/1976 | Curry | 215/219 |
| 4,204,614 | 5/1980 | Reeve | 222/153 |
| 4,516,695 | 5/1985 | Garneau | 222/380 X |
| 4,946,074 | 8/1990 | Grogan | 222/153 |
| 4,971,227 | 11/1990 | Knickerbocker et al. | 222/153 |
| 5,050,779 | 9/1991 | Knickerbocker | 222/153 |
| 5,088,628 | 2/1992 | Knickerbocker | 222/380 X |
| 5,169,032 | 12/1992 | Steijns et al. | 222/380 X |
| 5,207,359 | 5/1993 | Steijns | 222/383 |
| 5,228,600 | 7/1993 | Steijns et al. | 222/380 X |

FOREIGN PATENT DOCUMENTS

| | | | |
|---|---|---|---|
| 291985 | 8/1967 | Australia | 215/219 |
| 0467554 | 1/1992 | European Pat. Off. | 222/380 |
| 2724337 | 12/1978 | Germany | 215/219 |

*Primary Examiner*—Kevin P. Shaver
*Attorney, Agent, or Firm*—Thomas R. Vigil

[57] ABSTRACT

The child-resistant nozzle cover is used to cover a nozzle cap of a nozzle assembly for a trigger sprayer having a body, the nozzle assembly including a nose bushing at a front end of the body, the nozzle cap being rotatably mounted on the nose bushing of the sprayer, and the nozzle cap having a proximal end, a distal end including a generally annular rear edge, and an outer surface. The cover comprises a generally annular hood substantially covering the outer surface of the nozzle cap, being rotatable about the nozzle cap and nose bushing and having a proximal end, a distal end, an outer peripheral surface and an inner generally annular surface. Retaining structure is provided at the proximal end of the hood for retaining the hood on the nozzle assembly. The hood is made of flexible or resilient material so that upon applying sufficient radial forces to the hood generally on a diameter extending transversely of the hood, the hood becomes distorted and frictionally engages the nozzle cap whereby the nozzle cap can be rotated by rotating the hood then engaging the nozzle cap.

10 Claims, 3 Drawing Sheets

CHILD RESISTANT NOZZLE COVER

BACKGROUND OF THE INVENTION

1. Field of the Invention

The present invention relates to a child-resistant nozzle assembly at the front end of a trigger sprayer. More specifically, the present invention relates to a nozzle cover or hood which is rotatably mounted on a nose bushing of a trigger sprayer and surrounds a nozzle cap which also is rotatably mounted on the nose bushing independently of the hood. The hood substantially surrounds an outer periphery of the nozzle cap such that in order to turn the nozzle cap, the hood must be grasped by a person and squeezed with sufficient force to engage the nozzle cap.

2. Description of the Related Art Including Information Disclosed under 37 CFR §§1.97–1.99.

Heretofore, various child resistant structures and covers for a nozzle cap of a nozzle assembly for a trigger sprayer have been proposed. Several examples of such structures and covers are disclosed in the following U.S. Patents:

| U.S. Pat. No. | Patentee |
|---|---|
| 4,946,074 | Grogan |
| 4,971,227 | Knickerbocker et al. |
| 5,169,032 | Steijns et al. |
| 5,207,359 | Steijns |
| 5,228,600 | Steijns et al. |

SUMMARY OF THE INVENTION

According to the present invention there is provided a child-resistant nozzle cover for a nozzle cap of a nozzle assembly for a trigger sprayer having a body, the nozzle assembly including a nose bushing at a front end of the body, the nozzle cap being rotatably mounted on the nose bushing of the sprayer, and the nozzle cap having a proximal end, a distal end including a generally annular rear edge, and an outer surface. The cover comprises a generally annular hood substantially covering the outer surface of the nozzle cap, being rotatable about the nozzle cap and nose bushing and having a proximal end, a distal end, an outer peripheral surface and an inner generally annular surface. Retaining structure is provided at the proximal end of the hood for retaining the hood on the nozzle assembly. The hood is made of flexible or resilient material so that upon applying sufficient radial forces to the hood generally on a diameter extending transversely of the hood, the hood becomes distorted and frictionally engages the nozzle cap whereby the nozzle cap can be rotated by rotating the hood then engaging the nozzle cap.

DESCRIPTION OF THE PREFERRED EMBODIMENT(S)

Figure 1:
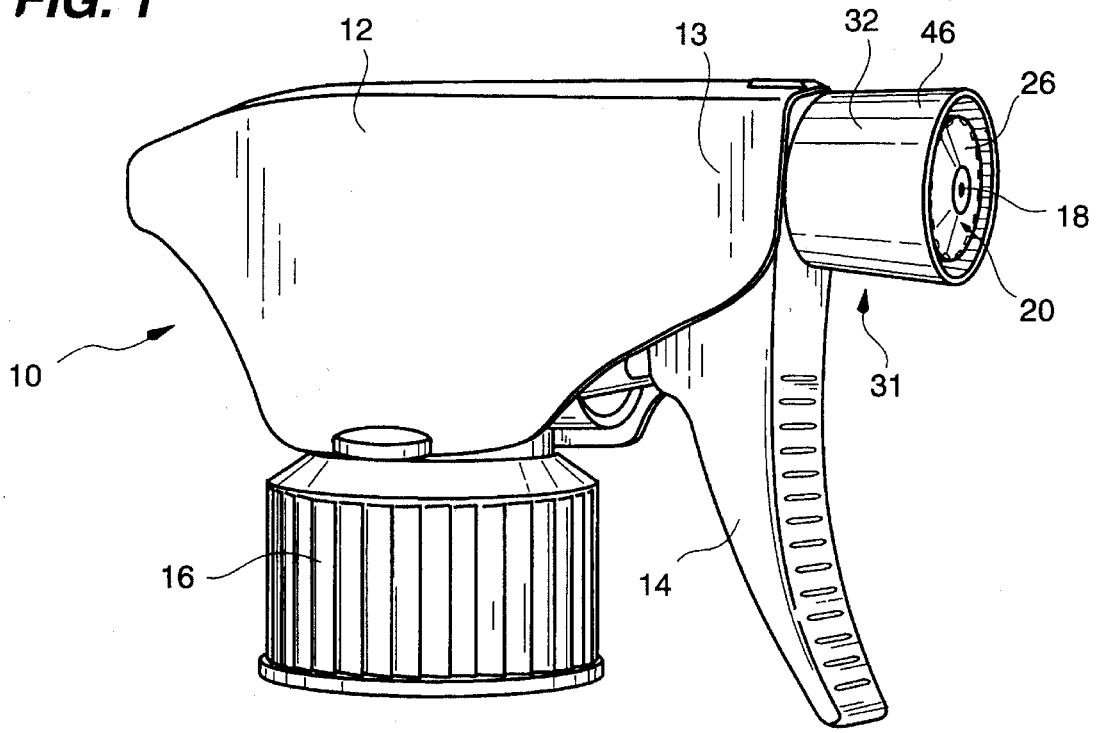
FIG. 1 is a perspective view of a trigger sprayer including a nozzle cap having a child-resistant nozzle cover thereon constructed according to the teaches of the present invention.

Referring now to FIG. 1, there is shown therein a trigger sprayer 10 having a body 12, a nose bushing 22 (see FIG. 3) at a front end of the body 12 and a trigger 14 pivotally mounted to the front 13 of the body 12 for engaging a pumping mechanism (not shown) which is of conventional construction within the body 12 for pumping liquid from a bottle which is connected to the body 12 by a connector 16 and out of an outlet orifice 18 of a nozzle cap 20 which is rotatably mounted on the nose bushing 22 of the sprayer 10.

Figure 3:
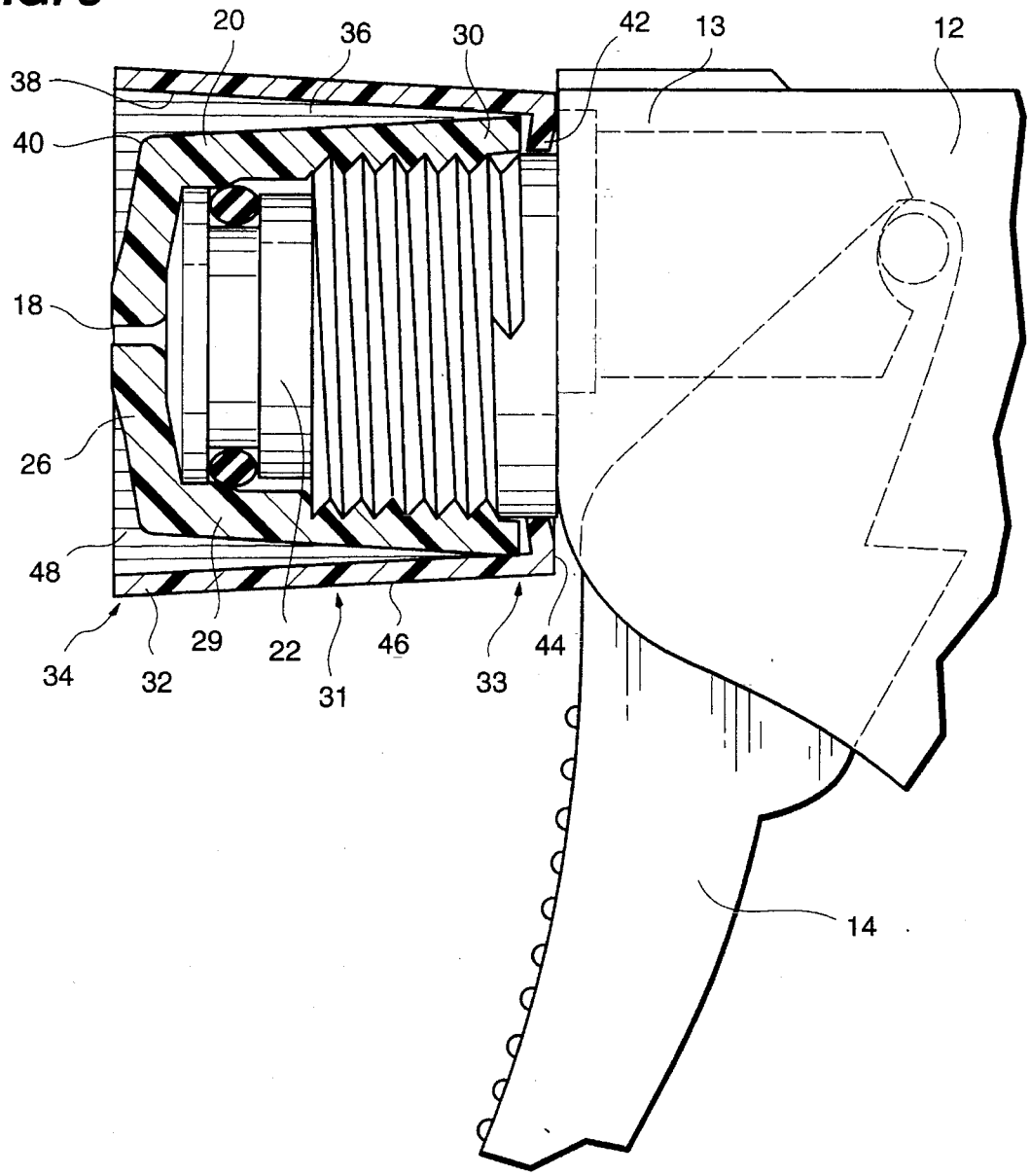
FIG. 3 is a sectional side view of the trigger sprayer showing a nozzle assembly of the nozzle cap mounted on a nose bushing with the child-resistant nozzle cover received over the nozzle cap.

The nozzle cap 20, as illustrated in FIG. 3, is generally cup shaped and has longitudinally extending flutes 23 in an outer peripheral wall surface 24 thereof. The nozzle cap includes a front wall 26 (bottom of the cup) at a distal end 28 of the nozzle cap 20 and an annular wall 29 (side wall of the cup) having the outer surface 24. The front wall 26 of the nozzle cap 20 has the outlet orifice 18 therein.

The nozzle cap 20 also has a proximal end 30 which is open so that the nozzle cap 20 can be threaded onto the nose bushing 22. In FIG. 3 the nozzle cap 20 is shown fully threaded onto the nose bushing 22.

Figure 2:
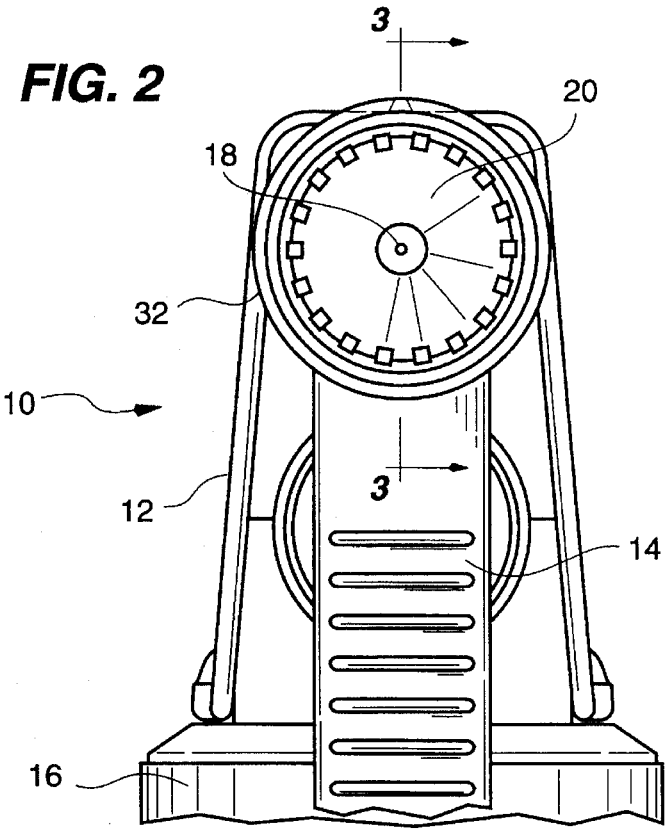
FIG. 2 is a front view of the trigger sprayer and nozzle cover shown in FIG. 1.

As shown in FIGS. 1, 2 and 3, and according to the teachings of the present invention, a child-resistant cover 31 is provided for the nozzle cap 20 and includes a generally annular hood 32 which is also rotatably mounted on the nose bushing 22 of the sprayer 10. The hood 32 substantially surrounds the annular wall 29 of the nozzle cap 20.

Figure 4:
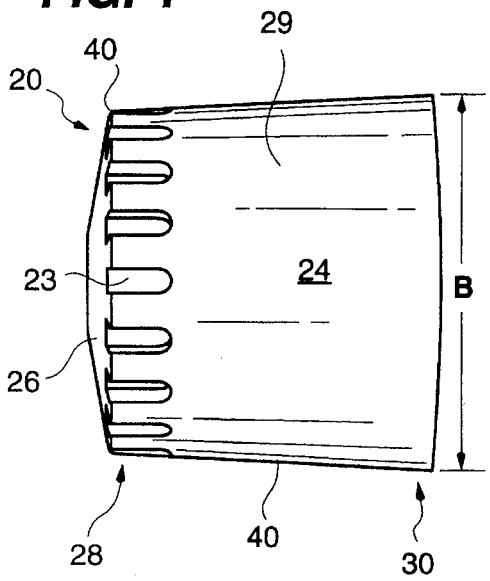
FIG. 4 is a side elevational view of the nozzle cap shown in FIG. 1.
Figure 5:
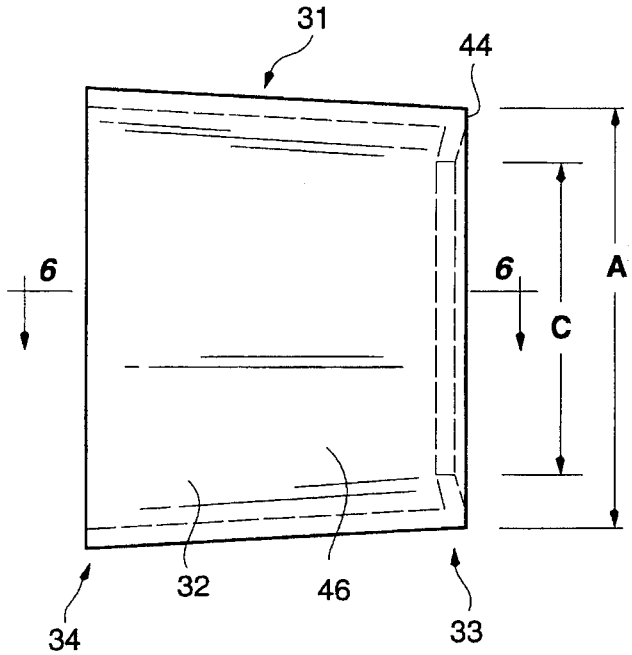
FIG. 5 is a side elevational view of the child-resistant nozzle cover shown in FIG. 1.

The hood 32 can be annular or as shown, slightly frustoconical in shape and has a proximal portion 33 and a distal portion 34. As shown, the distal portion 34 is slightly larger in diameter than the proximal portion 33. An inner diameter, A, of the hood 32 is greater than an outer diameter, B, of the cap, such that a gap or annular space 36 is created between an inner surface 38 of the hood 32 and an outer surface 24 of the cap 20. The annular space 36 is larger at the distal portion 34 of the hood 32 than at the proximal portion 33 of the hood 32. Note that as shown in FIG. 4, the outer surface 24 of the nozzle cap 20 is generally smooth.

The hood 32 has retaining structure in the form of an annular flange 42 which extends radially inwardly from a proximal edge 44 of the hood 32. The annular flange 42 has an inner diameter, C, that is less than the outer diameter, B, of the proximal end 30 of the nozzle cap 20. Because the outer diameter, B, of the proximal end 30 of the nozzle cap 20 is larger than the inner diameter, C, of the annular flange 42 of the hood 32, the hood 32 cannot be removed from the nose bushing 22 when the hood 32 and the cap 20 are mounted as shown in FIG. 3 with the flange 42 located between the front 13 of the body and the proximal annular end 30 of the nozzle cap 20. In other words, when both the nozzle cap 20 and hood 32 are properly mounted on the nose bushing 22, the nozzle cap 20 prevents the hood 32 from being removed from the nose bushing 22.

In order to mount the hood 32 properly on the nose bushing 22, the hood 32 must be placed onto the nose bushing 22 before the nozzle cap 20. After the hood 32 has been placed onto the nose bushing 22, the nozzle cap 20 can be rotatably mounted or threaded onto the nose bushing 22 in order to prevent the hood 32 from coming off of the nose bushing 22.

Figure 6:
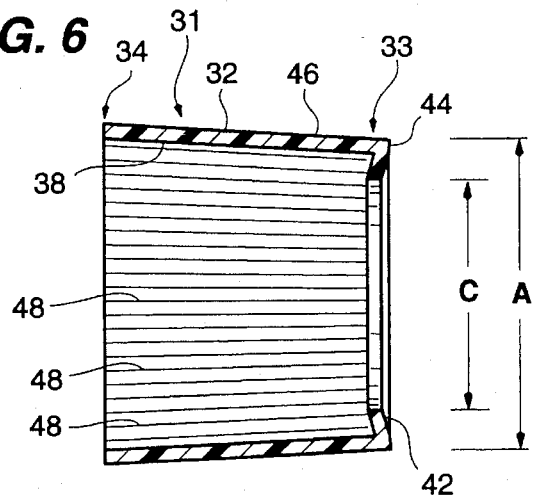
FIG. 6 is a sectional view of the child-resistant nozzle cover and is taken along the line 6—6 of FIG. 5.

The hood 32 is made of a flexible, resilient material, preferably plastic. The hood 32 also has an outer surface 46 which is generally smooth. The hood 32, as shown in FIGS. 3 and 6, has a plurality of longitudinal score marks or small grooves 48 cut into the inner surface 38. Note also that as shown, the lateral length of the hood 32 is such that it extends beyond an annular corner 40 between the outer surface 24 of the annular wall 29 and the front wall 26 of the nozzle cap 20.

The cap 20 can be moved from the fully threaded position of FIG. 3, to a partially threaded position (not shown), by rotating the nozzle cap 20 on the nose bushing 22 which causes the nozzle cap 20 to move axially with respect to the nose bushing 22.

Figure 7:
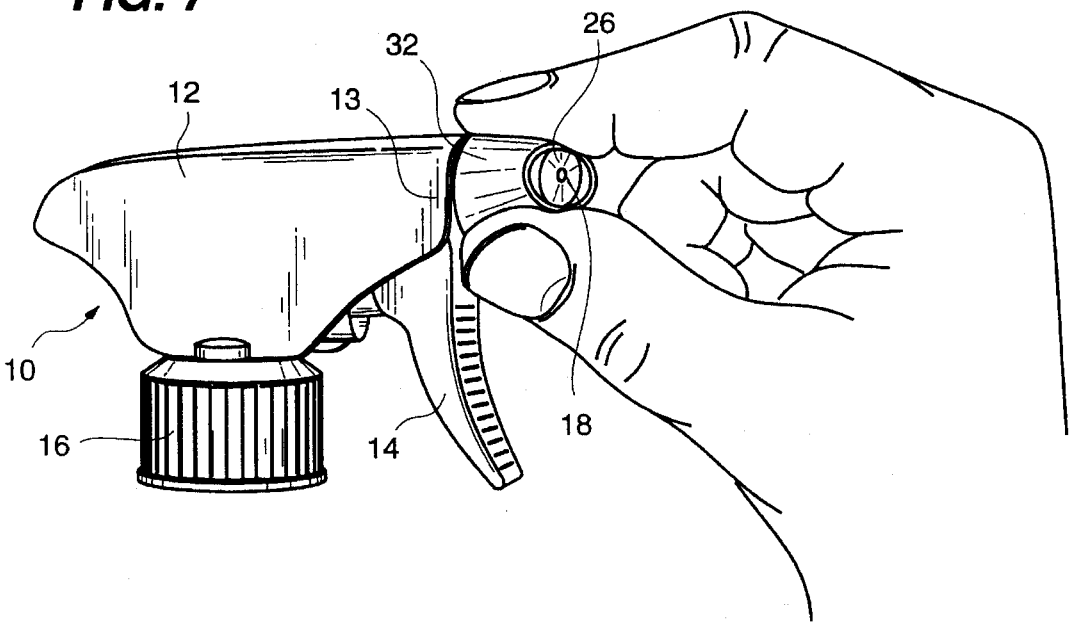
FIG. 7 is a perspective view of the trigger sprayer and nozzle cover showing the nozzle cover being squeezed to engage the nozzle cap.

In order to rotate the nozzle cap 20 with the hood 32 mounted on the nose bushing 22, a person must grasp and squeeze the flexible hood 32 with enough force so that the flexible hood 32 becomes distorted, and, at the same time, the inner surface 38 of the hood 32 engages the outer surface 24 of the nozzle cap 20 as illustrated in FIG. 7. The frictional engagement of the nozzle cap 20 by the hood 32 is facilitated by the longitudinal score marks or small grooves 48 which make the inner surface 38 of the hood 32 rough.

When the inner surface 38 of the flexible hood 32 frictionally engages the outer surface 24 of the nozzle cap 20, rotating the hood 32, the nozzle cap 20 is caused to rotate as well.

The amount of force needed to be applied to the hood 32 in order to frictionally engage the cap 20 is generally more force than a child can apply to the hood 32 while simultaneously turning the cap 20.

If a person, i.e., a child, squeezes the hood 32 with insufficient force, the inner surface 38 of the hood 32 will not frictionally engage the cap 20 and then, when the hood 32 is rotated, the hood 32 will simply rotate about the nose bushing 22 and on the nozzle cap 20 without rotating the nozzle cap 20 also.

Rotation of the nozzle cap 20 is what causes movement of the nozzle cap 20 from a fully threaded "OFF" position, as shown in FIG. 3, to an operable "SPRAY" or "STREAM" position (not shown) where upon actuation of the trigger 14, liquid is pumped from the bottle, through the sprayer 10 and out of the orifice 18 in a spray or stream pattern.

From the foregoing description, it will be apparent that the child-resistant nozzle cover 31 of the present invention has a number of advantages, some of which have been described above and others of which are inherent in the invention. Also it will be understood that modifications can be made to the child-resistant nozzle described above without departing from the teachings of the present invention. Accordingly, the scope of the invention is only to be limited as necessitated by the accompanying claims.

I claim:

1. A child-resistant nozzle cover for a nozzle cap of a nozzle assembly for a trigger sprayer having a body and a nose bushing of the nozzle assembly at a front end of the body, the nozzle cap being rotatably mounted on the nose bushing of the sprayer and the nozzle cap being generally cylindrical or generally conical in shape and having a proximal end, a distal end including a generally annular rear edge and a generally annular outer surface, said cover comprising;

a generally annular hood substantially covering the outer surface of the nozzle cap, being rotatable about the nozzle cap and nose bushing and an open proximal end, an open distal end, an outer peripheral surface and an inner generally annular surface;

retaining means at said proximal end of said hood for retaining said hood on the nozzle assembly; and, said hood being flexible or resilient so that upon applying sufficient radial forces to said hood, generally on a diameter extending transversely of said hood, said hood becomes distorted and frictionally engages the nozzle cap whereby said nozzle cap can be rotated by rotating said hood then engaging the nozzle cap.

2. The child-resistant nozzle cover of claim 1 wherein said retaining means includes a radially inwardly extending annular flange at the proximal end of said hood, said flange having an inner edge and being received behind the annular rear edge of the cap just in front of the body.

3. The child-resistant nozzle cover of claim 1 wherein said inner surface of said hood has a plurality of longitudinally extending grooves or score lines thereon so that when said flexible hood engages said nozzle cap, said scored lines allow the inner surface of said hood to frictionally engage said outer surface of the nozzle cap.

4. The child-resistant nozzle cover of claim 1 wherein said hood is slightly tapered or frusto-conical in shape so that the proximal end has a smaller diameter than a diameter of said distal end.

5. The child-resistant nozzle cover of claim 1 wherein said outer surface of said nozzle cap is smooth.

6. The child-resistant nozzle cover of claim 1 wherein said inner surface of said hood has a greater lateral or transverse extent than the lateral or transverse extent of the nozzle cap.

7. The child-resistant nozzle cover of claim 1 being made of plastic.

8. The child-resistant nozzle cover of claim 1 wherein said hood extends forwardly from said proximal end to said distal end a distance which extends slightly beyond a distal end of the outer surface of the nozzle cap.

9. The child-resistant nozzle cover of claim 1 including means on said inner surface of said hood for facilitating gripping engagement of the generally annular outer surface of the nozzle cap by said inner surface of said hood.

10. A method of assembling a child-resistant cover on a nozzle cap of a nozzle assembly that also includes a nose bushing at a front end of the body of a trigger sprayer on which the nozzle cap is rotatably mounted, comprising the steps of:

providing a nose bushing at the front end of a body of a trigger sprayer;

providing a nozzle cap having a proximal end, a distal end and an outer surface;

providing a flexible hood including a hood having a proximal end, a distal end, a generally annular outer surface and a generally annular inner surface;

mounting the hood onto the nose bushing;

rotatably mounting the nozzle cap onto the nose bushing inside of, but independently of the hood;

whereby the hood substantially covers all of the outer surface of the nozzle cap and is freely rotatable about the nozzle cap and so that upon application of a radial forces to the hood generally along a diameter of the hood, the hood frictionally engages the nozzle cap and the nozzle cap can be rotated by rotating the squeezed hood engaging the cap.

* * * * *